US009103209B2

(12) United States Patent
Saikia et al.

(10) Patent No.: US 9,103,209 B2
(45) Date of Patent: Aug. 11, 2015

(54) SYSTEM FOR CONTROLLING SPEED OF TRAVEL IN A LONGWALL SHEARER

(71) Applicant: Caterpillar Global Mining LLC, South Milwaukee, WI (US)

(72) Inventors: Siddhartha Saikia, Chennai (IN); Euan Kirkhope, Cameron Park (AU); Martin Teiner, Hamm (DE); Jörg Wleklik, Herne (DE); Nicolas Schöneweiss, Lünen (DE)

(73) Assignee: Caterpillar Global Mining LLC, Oak Creek, WI (US)

( * ) Notice: Subject to any disclaimer, the term of this patent is extended or adjusted under 35 U.S.C. 154(b) by 0 days.

(21) Appl. No.: 14/224,463

(22) Filed: Mar. 25, 2014

(65) Prior Publication Data

US 2014/0203621 A1 Jul. 24, 2014

(51) Int. Cl.

| | |
|---|---|
| ***E21C 25/06*** | (2006.01) |
| ***E21C 35/24*** | (2006.01) |
| ***E21C 27/02*** | (2006.01) |
| ***E21C 27/32*** | (2006.01) |

(52) U.S. Cl.

CPC ..... *E21C 35/24* (2013.01); *E21C 27/02* (2013.01); *E21C 27/32* (2013.01)

(58) Field of Classification Search

CPC combination set(s) only.

See application file for complete search history.

(56) References Cited

U.S. PATENT DOCUMENTS

| | | | | | |
|---|---|---|---|---|---|
| 3,988,578 | A | * | 10/1976 | Weber | 299/1.6 |
| 4,634,186 | A | * | 1/1987 | Pease | 299/1.6 |
| 4,822,105 | A | * | 4/1989 | Yamada et al. | 299/1.6 |
| 4,976,495 | A | * | 12/1990 | Lewins et al. | 299/1.6 |

FOREIGN PATENT DOCUMENTS

| | | |
|---|---|---|
| IN | 251125 | 3/2012 |
| RU | 2098621 | 12/1997 |
| WO | 02064948 | 8/2002 |

* cited by examiner

*Primary Examiner* — John Kreck

(74) *Attorney, Agent, or Firm* — Miller, Matthias & Hull LLP

(57) ABSTRACT

A shearer system for removing material along a mineable distance relative to a mining environment includes a rail assembly to support movement of a shearer carriage thereon. The system further includes a haulage motor structured and arranged to move the shearer carriage along the rail assembly. The system has a rotatably driven cutter that is positionable relative to the shearer carriage. The system further includes an actuator supported by the shearer carriage for changing a cutting height of the cutter. The system further includes a controller that can control a velocity of the shearer carriage based on a translation speed of the cutter, a maximum speed of the shearer carriage, a current cutter height, and a desired cutter height. Optionally, the controller can further control the velocity of the shearer carriage based on a predetermined stopping distance of the shearer carriage.

21 Claims, 8 Drawing Sheets

SYSTEM FOR CONTROLLING SPEED OF TRAVEL IN A LONGWALL SHEARER

TECHNICAL FIELD

The present disclosure relates to a mining shearer system, and more particularly to a system for controlling speed of travel in a mining shearer system.

BACKGROUND

Mining shearer systems such as longwall shearers are generally employed in under-ground mining applications. The longwall shearers are configured to perform longwall mining of a coalface or other mineral deposits. During operation of the longwall shearer, a travel speed of the longwall shearers and/or articulation of shearer drums are typically controlled by an operator. The operators may manually track a profile of the coalface and may thereafter command a shearer carriage of the longwall shearer into a desired travel speed. For example, the operator may set a target travel speed into an ECM (electronic control module) of the longwall shearer. Similarly, upon manually tracking the profile of the coalface, the operators may command one or more shearer drums of the longwall shearer into a desired position. For example, the operators may provide the ECM with target position inputs for the shearer drums to follow the tracked profile such that the shearer drums perform optimal and/or maximum coal extraction.

Some systems have been developed in the past for implementation with longwall shearers and/or to make the longwall shearers operate autonomously. PCT Publication WO 02/064,948 relates to a method and device for controlling the advance and cutting roller height of a shearer loader according to the load measured directly on the roller carrier arm. However, such previously known systems do not vary a travel speed of the longwall shearer based on deviations from optimal and/or maximum coal extraction that may be anticipated for an onward coalface. Hence, implementation of such previously known systems with longwall shearers may not configure the longwall shearers to track or follow the profile of the coalface closely. Consequently, use of such known systems with longwall shearers may affect mining productivity.

SUMMARY

In one aspect, the present disclosure provides a shearer system for removing material along a mineable distance relative to a mining environment. The system includes a rail assembly to support movement of a shearer carriage thereon. The system further includes a haulage motor structured and arranged to move the shearer carriage along the rail assembly. The system has a rotatably driven cutter that is positionable relative to the shearer carriage. The system further includes an actuator supported by the shearer carriage for changing a cutting height of the cutter. The system further includes a controller that can control a velocity of the shearer carriage based on a translation speed of the cutter, a maximum speed of the shearer carriage, a current cutter height, and a desired cutter height.

In another aspect, the present disclosure provides a shearer system for removing material along a mineable distance relative to a mining environment. The system includes a rail assembly to support movement of a shearer carriage thereon. The system further includes a haulage motor structured and arranged to move the shearer carriage along the rail assembly. The system has a rotatably driven cutter that is positionable relative to the shearer carriage. The system further includes an actuator supported by the shearer carriage for changing a cutting height of the cutter. The system further includes a controller that can control a velocity of the shearer carriage based on a translation speed of the cutter, a maximum speed of the shearer carriage, a current cutter height, and a desired cutter height. Optionally, the controller can further control the velocity of the shearer carriage based on a predetermined stopping distance of the shearer carriage.

In another aspect, the present disclosure provides a method of controlling a shearer carriage of a shearer system having a haulage motor in drivable engagement with the shearer carriage, and at least one rotatably driven cutter associated with the shearer carriage for removing material along a coalface. The method includes determining a translation speed of the cutter, a maximum speed of the shearer carriage, a current and a desired height of the cutter, and a stopping distance required by the shearer carriage. The method includes controlling a velocity of the shearer carriage based on the translation speed of the cutter, the maximum speed of the shearer carriage, the current cutter height, and the desired height of the cutter. Optionally, the method includes further controlling the velocity of the shearer carriage based on the predetermined stopping distance of the shearer carriage.

Other features and aspects of this disclosure will be apparent from the following description and the accompanying drawings.

DETAILED DESCRIPTION

Figure 1:
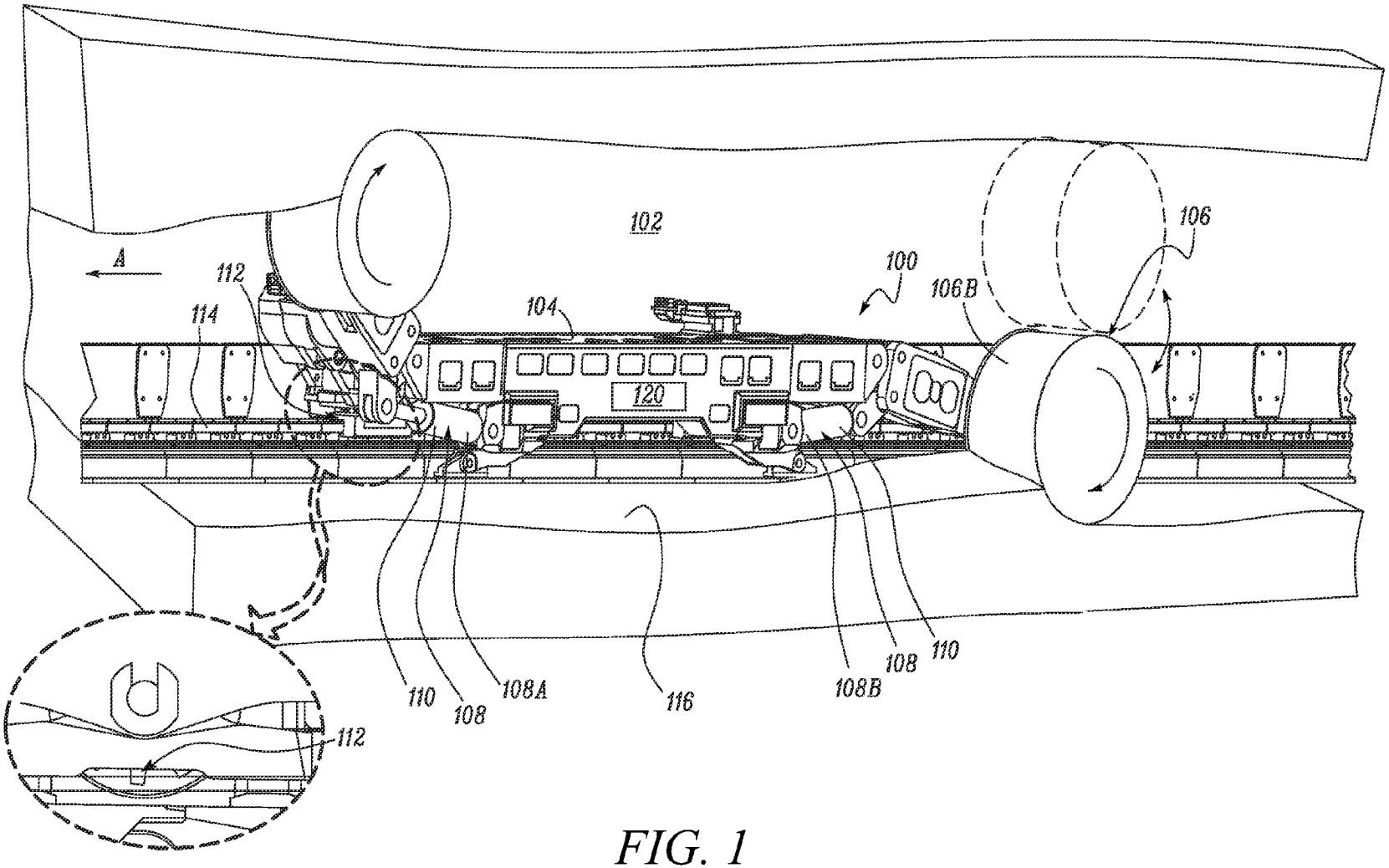
FIG. 1 is a diagrammatic representation of an exemplary shearer system employing cutters for mining coal from an exemplary coalface.

The present disclosure relates to a system for controlling speed of travel in a mining shearer system. Wherever possible the same reference numbers will be used throughout the drawings to refer to same or like parts. FIG. 1 shows a diagrammatic representation of an exemplary mining shearer system 100 for removing material along a mineable distance relative to a mining environment 102. The mining environment 102 disclosed herein may be an exemplary coalface. Accordingly, as shown in FIG. 1, the mining shearer system 100 is embodied as a longwall shearer.

For the sake of simplicity and convenience in referring to components of the present disclosure, the mining shearer system will hereinafter be referred to as the longwall shearer and will be designated with the same reference numeral 100. Further, although the present disclosure is described in conjunction with the longwall shearer 100, it is to be noted that the mining shearer system can be embodied by other machines commonly known in the art for performing extraction of coal.

Similarly, the mining environment will hereinafter be referred to as the coalface and will be designated with such identical reference numeral 102. Further, although the present disclosure is described in conjunction with coal and/or the coalface 102, the coal and/or the coalface 102 disclosed herein is merely exemplary in nature and non-limiting of this disclosure. The longwall shearer 100 can optionally be configured to perform mining of other minerals deposits such as, but not limited to, bauxites, sulfides, oxides, halides, carbonates, sulfates, phosphates or other mineral deposits commonly found under a surface of the earth. Accordingly, a person of ordinary skill in the art will appreciate that systems, structures, and methods disclosed herein are similarly applicable for implementation and use with other types of longwall shearers independent of the mineral deposit or substance extracted with use thereof.

Referring to FIG. 1, the longwall shearer 100 includes a rail assembly 114 to support movement of a shearer carriage 104 thereon. The system further includes a haulage motor 112 structured and arranged to move the shearer carriage 104 along the rail assembly 114. Although the present disclosure will be explained in conjunction with the haulage motor 112, it is to be noted that systems, and methods disclosed herein may be similarly applied to other types of propelling arrangements associated with the longwall shearer 100. Optionally, it can be contemplated to also modify the systems and/or methods, disclosed herein, for suitable implementation with other configurations of longwall shearers, futuristic or present, without deviating from the spirit of the present disclosure. Accordingly, various embodiments herein are presented in the illustrative or explanatory sense, and to aid a reader's understanding of the present disclosure. Hence, the present disclosure should not be construed as being limited to the specific embodiments herein, but may extend to include other possible configurations, variations, and/or modifications thereto.

The longwall shearer 100 includes at least one rotatably driven cutter 106 therein. The cutter 106 is pivotably mounted on the shearer carriage 104 (two cutters 106*a*, 106*b* are shown associated with the shearer carriage 104 of the longwall shearer 100 in FIG. 1). The cutters 106 are positionable relative to the shearer carriage 104 for interfacing with the coalface 102 and performing extraction of coal therefrom.

The longwall shearer 100 further includes an actuator 108 supported by the shearer carriage 104 for changing a cutting height of the cutter 106. The actuator 108 is configured to pivotally connect the cutter 106 to the shearer carriage 104. In the specific embodiment of FIG. 1, the two cutters 106*a*, 106*b* are shown pivotally connected to the shearer carriage 104 by two individual actuators 108*a*, 108*b* (i.e., one actuator 108 associated with each cutter 106). Each of the actuators 108 may include at least one hydraulic cylinder 110 therein which is operable between a fully extended state and a fully retracted state. When in the fully extended state, the hydraulic cylinders 110 may cause the associated cutter 106*a* or 106*b* to be located at the highest position relative to the shearer carriage 104. When in the fully retracted state, the hydraulic cylinders 110 may result in the associated cutter 106*a* or 106*b* to be located lowest in position relative to the shearer carriage 104.

In order to execute movement in the actuators 108*a*, 108*b*, the longwall shearer 100 may include associated system hardware (not shown) such as, but not limited to, pumps, compressors, electric motors and/or other components typically known for accomplishing actuation of hydraulic cylinders 108. Moreover, although the actuators 108*a*, 108*b* are disclosed herein as being of a hydraulic type, in other implementations of the present disclosure, the actuators 108*a*, 108*b* could be formed from electric motors, gears, and other mechanical linkages for performing arm raise and lowering. Moreover, the longwall shearer 100 may additionally include drivers and/or other transmission components to execute movement of the hydraulic cylinders 108. Therefore, during operation of the longwall shearer 100, the actuators 108*a*, 108*b* may be operable to pivot the cutters 106*a*, 108*b* respectively about the shearer carriage 104 and allow the cutters 106*a*, 106*b* to accomplish cutting of the coalface 102.

With continued reference to FIG. 1, the longwall shearer 100 further includes a controller 120 for controlling a speed of travel of the shearer carriage 104 (as indicated by a direction arrow A). Explanation pertaining to the working of the controller 120 will be made hereinafter in combined reference to FIGS. 2 to 7.

Figure 2:
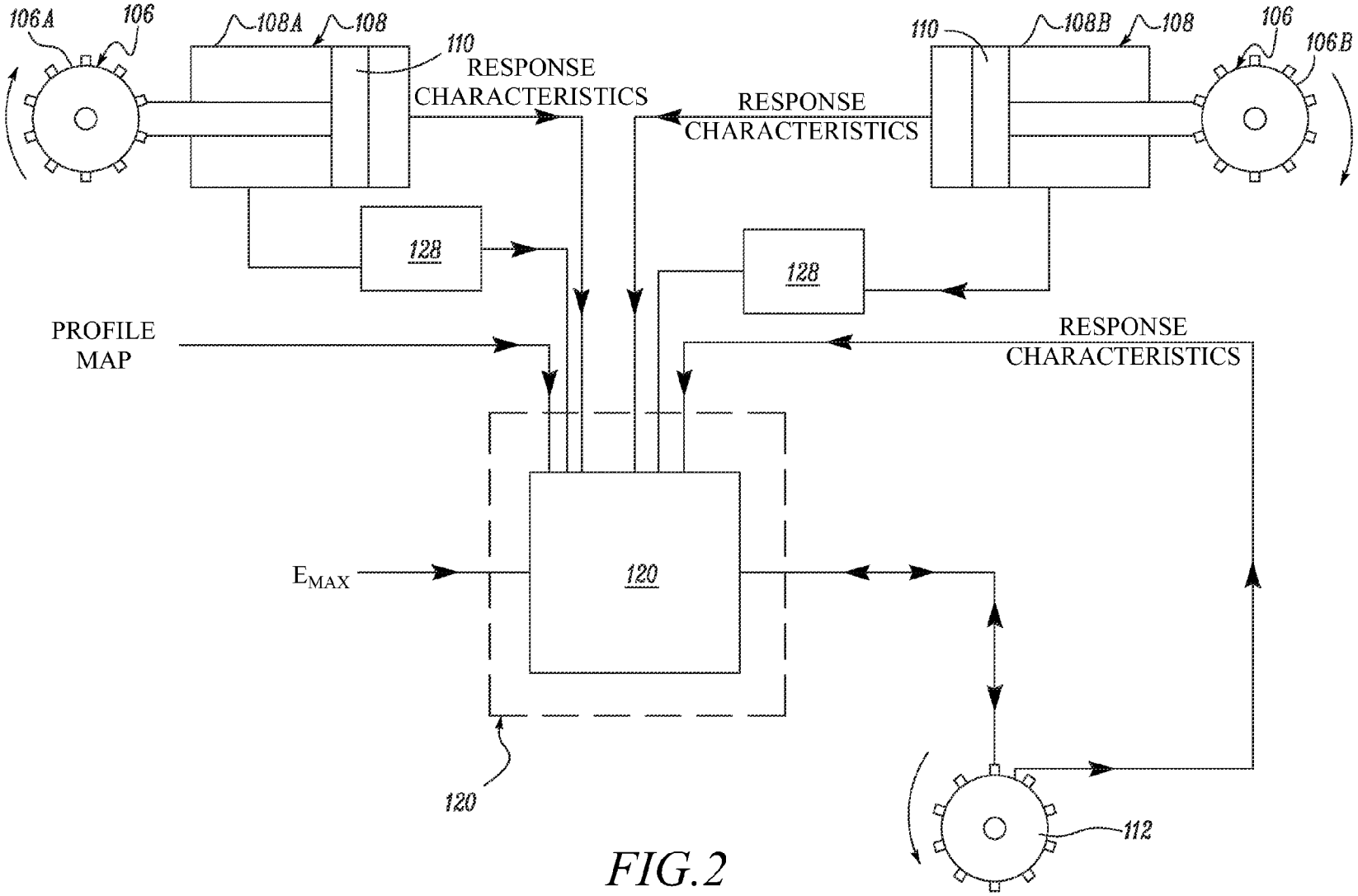
FIG. 2 is a schematic representation of a controller employed by the exemplary shearer system in accordance with an embodiment of the present disclosure.

Referring to FIG. 2, in one mode of operation, the controller 120 can control a velocity of the shearer carriage 104 based on a translation speed of the cutter 106 (i.e., speed at which the cutter 106 can be raised or lowered, hereinafter referred to as "arm speed"), a maximum speed of the shearer carriage 104, a current height of the cutter 106, and a desired height of the cutter 106. The controller 120 is preset with a profile map of the coalface 102. The profile map could be a manually recorded profile or a profile imported from geological maps. Therefore, the desired height of the cutter 106 is predetermined based on the profile map of the coalface 102 and the controller 120 may use such profile map to determine the desired height of the cutter 106. The longwall shearer 100 may include one or more sensors 128 communicably coupled to the controller 120. The sensors 128 may be, but are not limited to, inclinometers or potentiometers and can be configured for measuring the current height of the cutter 106. The controller 120 may predict an error based on a difference between the current height of the cutter 106 and the desired height obtained from the profile map for at least the predetermined stopping distance of the shearer carriage 104. The predetermined stopping distance, disclosed herein, is the distance required by the shearer carriage 104 to be brought to a minimum crawling speed or optionally to a halt. The stopping distance may vary depending on the current travel speed of the longwall shearer 100, and gradients or slopes present in the angle of the rail assembly 114 and/or the subterranean surface 116 that may affect the travel speed of the longwall shearer 100. Moreover, in one embodiment, the stopping distance of the shearer carriage 104 can be determined using the rate of deceleration at the haulage motor 112. The controller 120 may compute the rate of deceleration required at the haulage motor 112 based on the response characteristics of the haulage motor 112. The response characteristics of the haulage motor 112 may represent a rapidity with which the haulage motor 112 can achieve a target or desired rotational speed from its current rotational speed.

In another embodiment, the controller 120 may determine such rate of deceleration based on the response characteristics of the actuators 108*a*, 108*b*. The response characteristics of the actuator 108 may represent a rapidity with which the actuator 108 can execute movement such that the associated cutter 106*a* or 106*b* is articulated from its current height to a target or desired height for operation.

Typically, the response characteristics of the haulage motor 112 and/or the actuator 108 may be intrinsic to the construction of the haulage motor 112 and/or the actuator 108 and hence, may be known beforehand. For example, the response characteristics of the haulage motor 112 can be obtained from a speed-torque curve of the haulage motor 112. Similarly, response characteristics of the actuators 108 can be obtained from, for example, power-to-weight ratios of the actuators 108. In an embodiment, the response characteristics of the haulage motor 112 and the actuators 108 are obtained from actual field testing of the longwall shearer 100. However, the response characteristics can be alternatively be derived as test data obtained from various theoretical models, statistical models, simulated models or combinations thereof.

As disclosed earlier herein, the controller 120 may predict the error for at least the predetermined stopping distance of the shearer carriage 104 based on a difference between the current height of the cutter 106 and the desired height obtained from the profile map. The error, disclosed herein, may therefore be regarded as the deviation of the cutter 106 from a position at which optimal and/or maximum coal extraction is possible.

Figure 3:
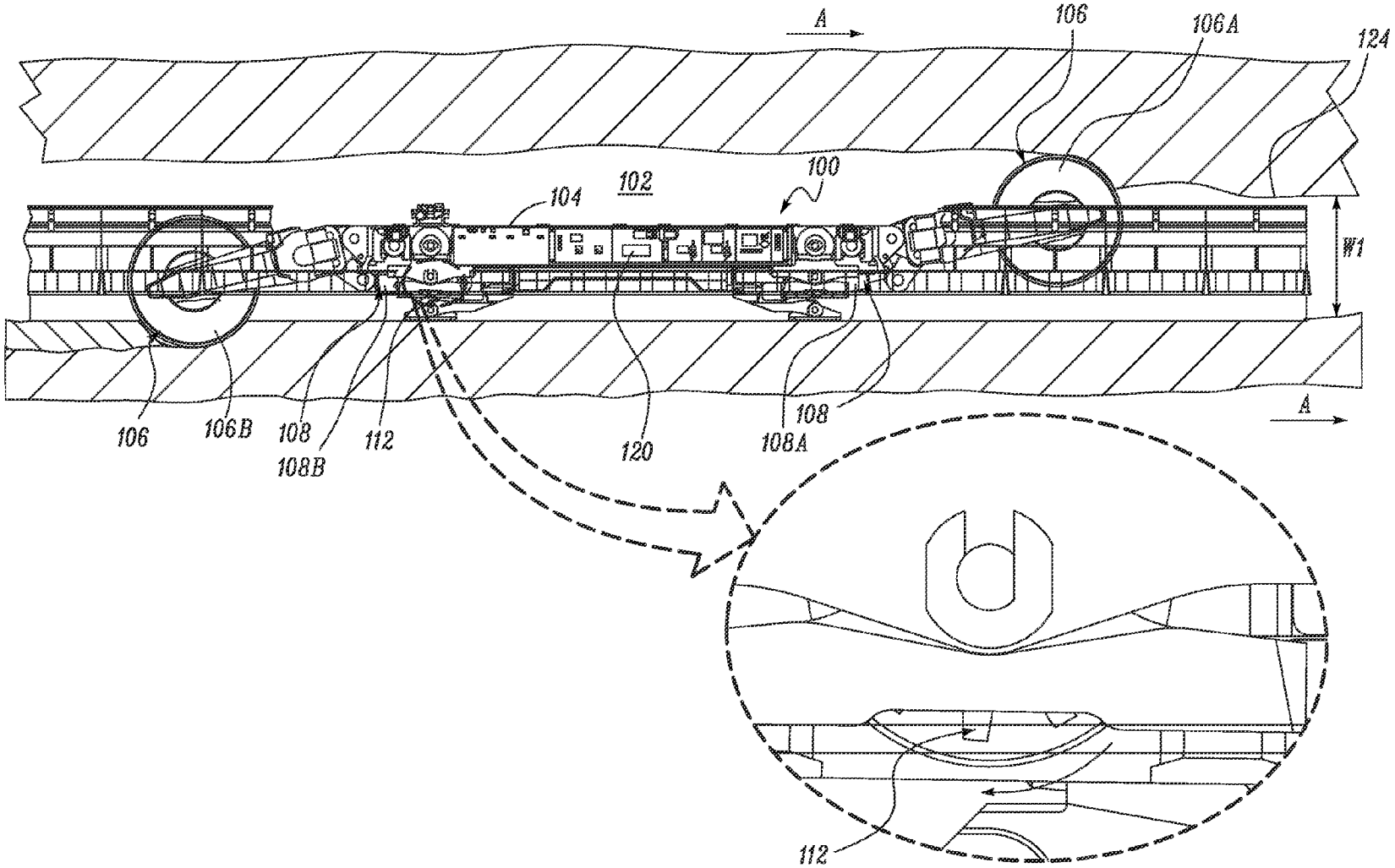
FIG. 3 is a diagrammatic representation of a situation in which a width of the coalface at an oncoming location is decreasing.

For example, as shown in FIG. 3, if a width W1 of the coalface 102 at an oncoming location is decreasing and with the current height of the cutter 106*a* being higher than a converging seam 124 of the coalface 102, the controller 120 predicts that the magnitude of error will be high. I.e. The controller 120 predicts that if the current height of the cutter 106*a* is continued to be employed while shearing the onward coalface 102, i.e., the deviation between the current position of the cutter 106*a* and a position of the cutter 106*a* at which optimal and/or maximum coal extraction is possible will be large.

Figure 4:
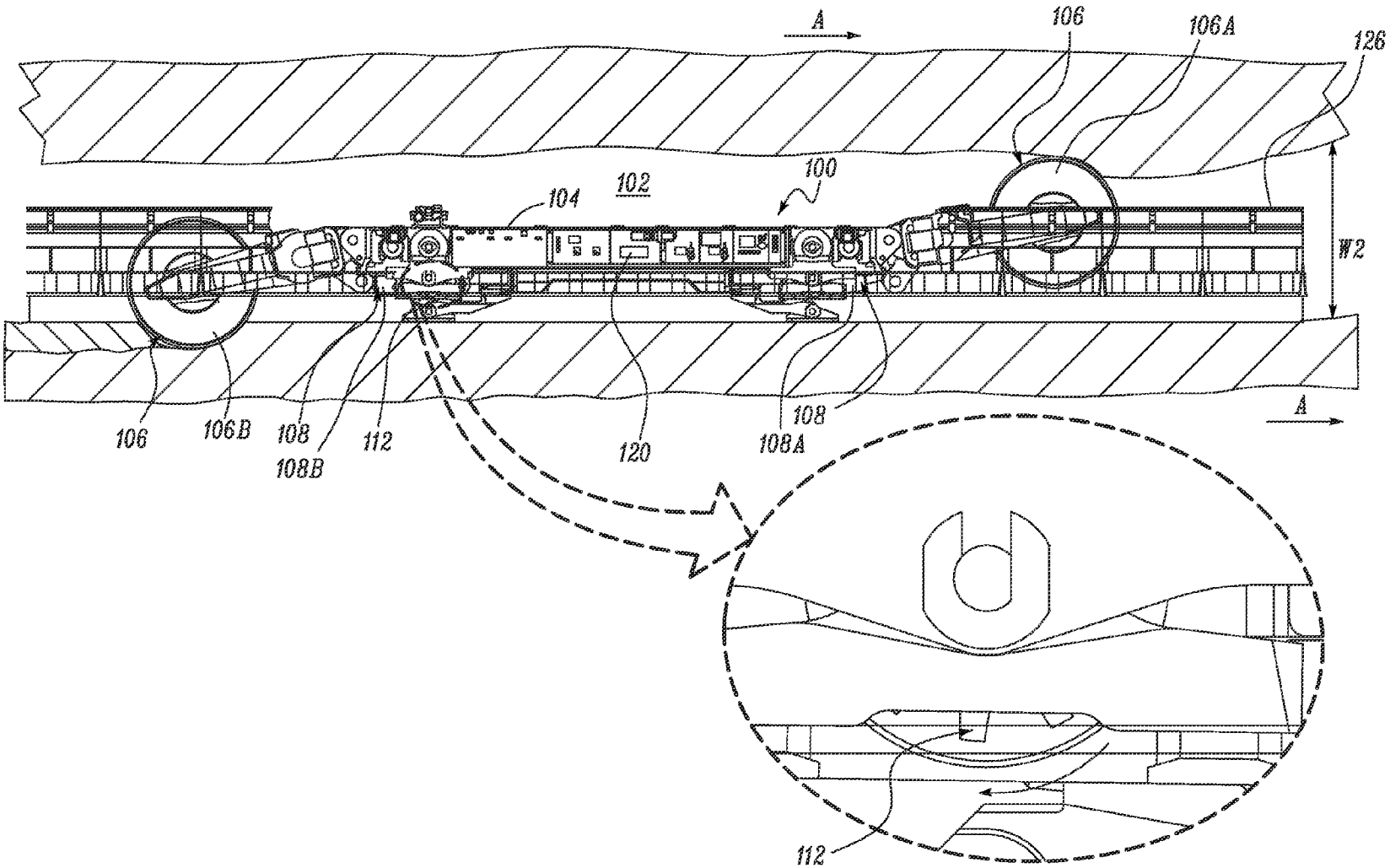
FIG. 4 is a diagrammatic representation of a situation in which a width of the coalface at an oncoming location is increasing.

In another example as shown in FIG. 4, if a width W2 of the coalface 102 at an oncoming location is increasing and with the current height of the cutter 106*a* being lower than a diverging seam 126 of the coalface 102, the controller 120 predicts that the magnitude of error will be high. I.e. The controller 120 predicts that if the current height of the cutter 106*a* is continued to be employed while shearing the onward coalface 102, the deviation between the current position of the cutter 106*a* and a position of the cutter 106*a* at which optimal and/or maximum coal extraction is possible will be large.

With reference to the preceding examples, the controller 120 may receive inputs, periodically or continuously, from the sensors 128 (See FIG. 2) associated with the actuator 108. The sensors 128, as disclosed herein, may provide articulation angles and/or positions of the respective cutters 106*a*, 106*b*. Thereafter, the controller 120 may compare the current position of one or both cutters 106*a*, 106*b* (obtained from the associated sensors 128) with data from the profile map of the coalface 102.

Figure 7:
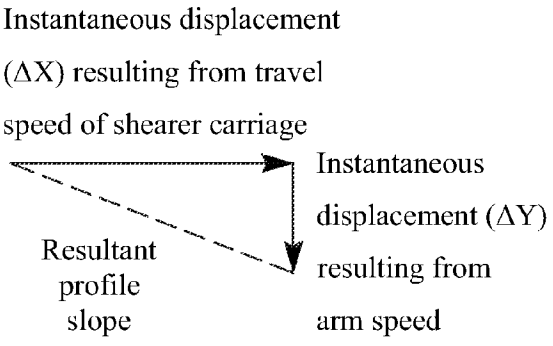
FIG. 7 is an exemplary vectorial representation of instantaneous displacements of the cutter resulting from arm speed and travel speed of the shearer system during shearing and drum lowering operation.
Figure 6:
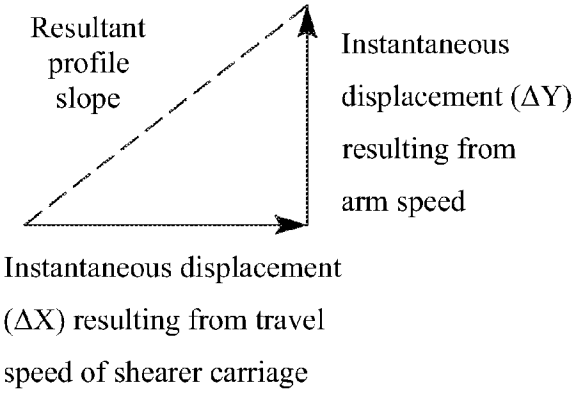
FIG. 6 is an exemplary vectorial representation of instantaneous displacements of the cutter resulting from arm speed and travel speed of the shearer system during shearing and drum raise operation.
Figure 8:
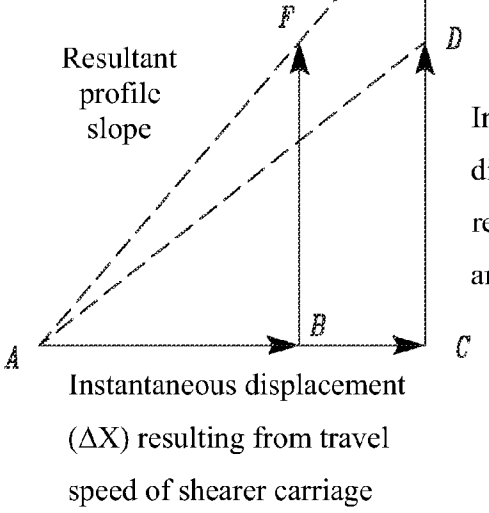
FIG. 8 is an exemplary vectorial representation of instantaneous displacements of the cutter resulting from arm speed and travel speed with and without implementation of the present system.

FIG. 6 illustrates an exemplary vector representation of instantaneous displacements of the cutter 106 resulting from arm speed (i.e. speed of the actuator 108 in raising the cutter 106) and travel speed of the shearer carriage 104. The simultaneous movement of the shearer carriage 104 and the cutter 106 results in the profile slope depicted by the dashed line. Similarly, FIG. 7 illustrates an exemplary vector representation of instantaneous displacements of the cutter 106 resulting from arm speed (i.e. speed of the actuator 108 in lowering the cutter 106) and travel speed of the shearer carriage 104. FIG. 8 illustrates an exemplary vector representation of instantaneous displacements of the cutter 106 resulting from arm speed for the cutter 106 during raise, and from the travel speed of the shearer carriage 104 with and without implementation of the controller 120 disclosed herein.

Referring to FIGS. 6-7, if ΔX is the instantaneous displacement resulting from the travel speed of the longwall shearer 100 and if ΔY is the instantaneous displacement resulting from arm speed, then the dashed line can be regarded as the resultant profile slope the cutter 106 follows with the given travel speed and given arm speed. Moreover, as shown in FIGS. 6-7, the profile slopes tracked by the cutter 106 while being raised and lowered are different due to different response characteristics of the actuator 108 in raising and lowering the cutter 106. However, it is to be noted that the representations of FIGS. 6 and 7 are merely exemplary in nature and non-limiting of the present disclosure. The resultant profile slopes for the cutter 106 when raised and lowered can change depending on various factors such as, but not limited to configurations, operating specifications, and/or response characteristics of the haulage motor 112 and the actuators 108.

Referring to FIG. 8, vector AC represents the maximum instantaneous displacement resulting from the travel speed of the longwall shearer 100 while vector CD represents the maximum instantaneous displacement resulting from the arm speed associated with the actuator 108. If the desired or required profile slope for optimal and/or maximum coal extraction at the onward coalface 102 is AE, and based on the current arm position, the error may be given by the vector CE. However, with use of the present controller 120, if the instantaneous displacement ΔX resulting from the travel speed is brought down from AC to AB, then the profile slope will be AF which has the same profile gradient as AE. At this point, the instantaneous displacement ΔY resulting from the arm speed can be BF i.e., equal to the vector CD, as shown in FIG. 7. Therefore, after reduction of the instantaneous displacement ΔX from AC to AB, the cutter 106 may track the profile slope AF which has the same gradient as AE such that the longwall shearer 100 is configured to perform optimal and/or maximum amount of coal extraction at the onward coalface 102.

The desired travel speed limit disclosed herein in conjunction with the controller 120 can be represented as follows:

$$\text{Desired travel speed limit}=[[V\cdot\text{Cos}(\theta)]\times\text{Max carriage speed}]/\text{Error} \qquad \text{eq. 1;}$$

Wherein

V is the tangential speed of the cutter;

θ is the current arm angle as deduced from the cutter height;

Max carriage speed is the maximum speed of the shearer carriage as input by the operator at the user interface, or the maximum speed of the shearer carriage defined from operating characteristics of the haulage motor; and Error is the difference between the current cutter height and the desired cutter height.

In an embodiment, the controller 120 modulates a rate of change of rotational speed of the haulage motor 112 based on a predicted magnitude of error. For purposes of ease in reference and clarity in understanding of the present disclosure, the rate of change of rotational speed of the haulage motor 112 will be hereinafter described as the rate of acceleration or the rate of deceleration of the haulage motor 112. The terms "acceleration" and "deceleration", as disclosed herein, will represent their usual meanings to the context of the present application unless explicitly stated otherwise i.e. acceleration will refer to an increase in the rotational speed of the haulage motor 112 while deceleration will refer to a decrease in the rotational speed of the haulage motor 112.

In one embodiment, the controller 120 may be configured to reduce the rotational speed of the haulage motor 112 based on a predicted increase in the magnitude of error. Therefore, with reference to examples rendered in conjunction with FIGS. 3 and 4, if the predicted error is high then the haulage motor 112 may be recommended by the controller 120 to decelerate at a specified rate of deceleration as determined by the controller 120. The controller 120 may execute such deceleration at the haulage motor 112 by sending appropriate command signals to the haulage motor 112. During operation of the longwall shearer 100, the maximum speed limit of the shearer carriage 104 is specified by an operator to the controller 120 via an interface (not shown). If the rock hardness and other operational characteristics are favorable, the operator may specify the maximum velocity of the shearer carriage 104 via the interface. However, as disclosed earlier herein, if the predicted error is high then the haulage motor 112 may be subject to deceleration as recommended by the controller 120. Moreover, the deceleration may be caused at the rate of deceleration as determined and specified by the controller 120 to the haulage motor 112.

With reference to the examples of FIGS. 3 and 4, and with continued reference to FIG. 2, if the predicted error for the onward coalface 102 is high, then the controller 120 may cause a reduction in rotational speed of the haulage motor 112. While doing so, the controller 120 may additionally determine a rate of deceleration required in the rotational speed of the haulage motor 112 and cause such rate of deceleration to be applied at the haulage motor 112 while reducing its rotational speed. Therefore, the rate of deceleration determined by the controller 120, may allow the shearer carriage 104 to slow down to a target travel speed and adapt its cutters 106 in the meantime before reaching the onward location. Thus, the longwall shearer 100 may incur little or no error in the height of its cutters 106 while shearing the onward coalface 102 i.e., the longwall shearer 100 is able to "look-ahead" for errors in the height of the cutters 106 up to a distance corresponding to the predetermined stopping distance. It is envisioned that with flexibility to vary the rate of deceleration at the haulage motor 112, the longwall shearer 100 may be able to adapt the cutters 106 to the desired height before reaching the onward location of the coalface 102.

Figure 5:
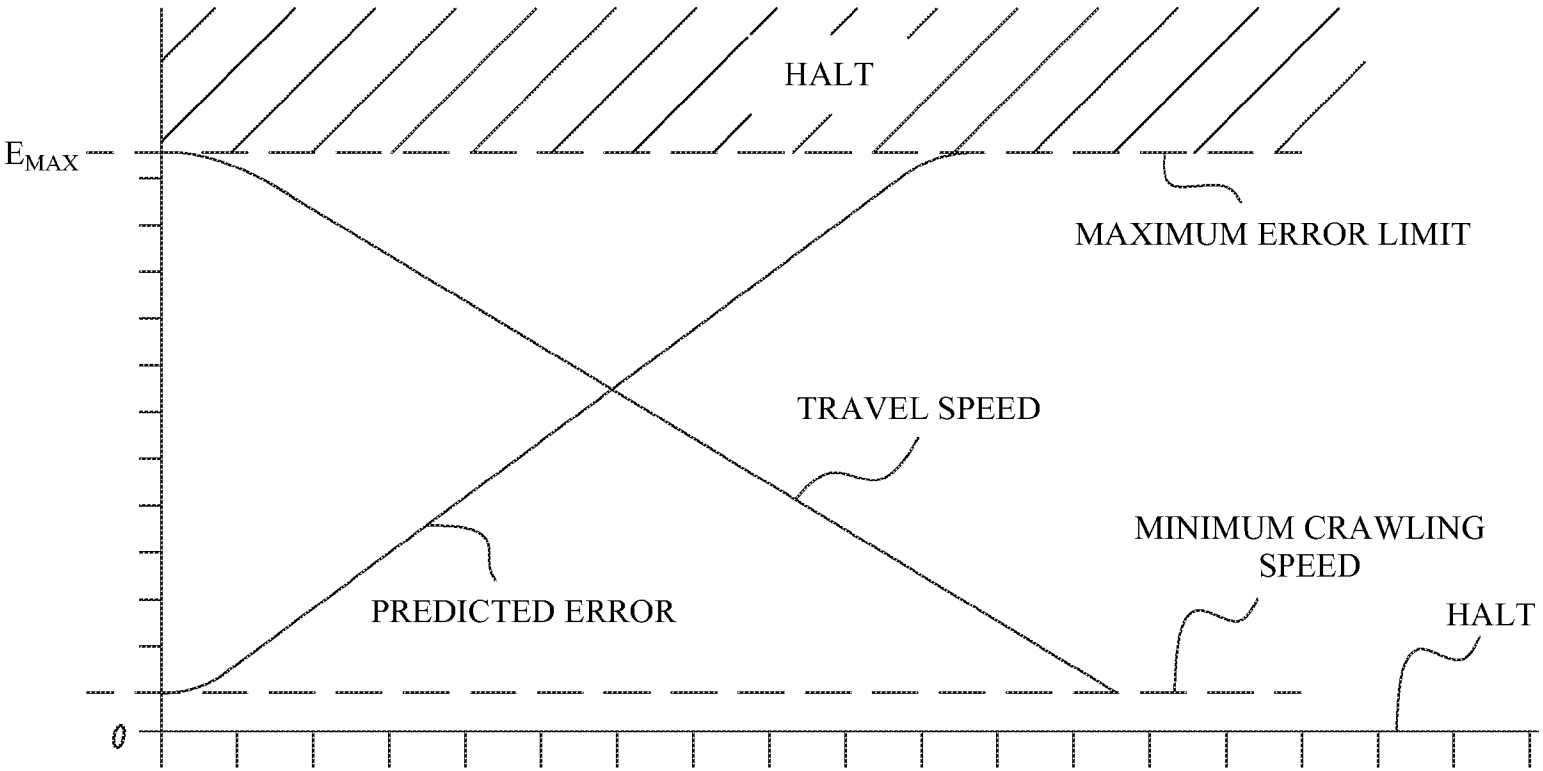
FIG. 5 is a graph showing the relationship between predicted error and travel speed of the shearer system.

Turning back to FIG. 2 and in reference to FIG. 5, in another embodiment, the controller 120 may be configured with a maximum error limit $E_{max}$. The maximum error limit $E_{max}$ disclosed herein may be based on one or more of operating specifications of the longwall shearer 100, dimensional specifications of the coalface 102, and/or shearer geometry of the longwall shearer 100. The operating specifications of the longwall shearer 100 may include, for example, an extent of overlap in shearing volumes of the forward and rearward cutter drums, diameter of the cutter drums, current state of cutting picks on the cutters 106, machine configuration, and the like. Further, the dimensional specifications of the coalface 102 may include a geometrical nature of the coal seam 124, 126 (i.e. converging, diverging, or rectilinear) and/or the width W1, W2 of the coalface 102. However, dimensional specifications of the coalface 102 may optionally include a depth of the coalface 102 (See FIGS. 3 and 4) to which shearing is desired in a single pass of the longwall shearer 100. Furthermore, shearer geometry, disclosed herein may represent a spatial volume exhibited through full range of movement by the cutter drums.

The maximum error limit $E_{max}$, disclosed herein, may be a substantially large value of error pre-set into the controller 120 prior to operation of the longwall shearer 100 on a given coalface 102. If the error predicted for the onward coalface 102 by the controller 120 is greater than the maximum error limit $E_{max}$, the controller 120 may command a reduction in the speed of the shearer carriage 104 to a minimum crawling speed or may completely bring the longwall shearer 100 to a halt depending on the mode of operation.

For example, it may be acceptable to have a predicted error of 50 millimeters (mm) or less for the onward coalface 102. However, it may not be acceptable to have an error of more than 150 millimeters at the onward coalface 102 i.e. 150 millimeters may be the maximum error limit $E_{max}$ configured in the controller 120. Therefore, during operation, if the error predicted for an onward coalface 102 is less than 50 millimeters, then the controller 120 may not command a decrease in the rotational speed of the haulage motor 112.

Optionally, in one exemplary embodiment of the present disclosure, if the predicted error is less than 50 mm, the controller 120 may alternatively configure the command an increase in the rotational speed of the haulage motor 112 and thereby accomplish increase in the travel speed of the longwall shearer 100. In doing so, the controller 120 may determine a target velocity for the shearer carriage 104 and may determine the rate of acceleration with which the target speed may be reached. With implementation of such an embodiment, the controller 120 may allow the longwall shearer 100 to maintain maximum mining productivity while performing optimal and/or maximum coal extraction.

However, if the error predicted for the onward coalface 102 lies between 50 mm and 150 mm, the controller 120 may command a reduction in the rotational speed of the haulage motor 112 based on the predicted increase in the magnitude of error, i.e. increase of error above 50 mm. For example, as shown in FIG. 5, if the controller 120 is a proportional controller, then the gain in the controller 120 is proportional to the error and therefore, the controller 120 may cause reduction of speed at the haulage motor 112 in a proportional manner. An exemplary relationship between the predicted error and the instantaneous displacement $\Delta X$ due to travel speed of the shearer carriage 104 is shown in FIG. 5. If the predicted error is high, the travel speed is kept low. Additionally, in realizing the target travel speed, the controller 120 may also set a high rate of deceleration. Alternatively, if the predicted error is low, the travel speed can be kept high. Additionally, the controller 120 may set a high rate of acceleration to reach the high travel speed quickly.

However, as disclosed herein, if the error predicted for the onward coalface 102 by the controller 120 is greater than the maximum error limit $E_{max}$, the controller 120 may command a reduction of the travel speed to a minimum crawling speed or even bring the longwall shearer 100 to a halt depending on the mode of operation. Therefore, with reference to the preceding example, if the error predicted for the onward coalface 102 is greater than 150 mm, then the controller 120 may reduce the travel speed to a minimum crawling speed or may completely bring the longwall shearer 100 to a halt.

It is to be noted that the numerical values of 50 mm and 150 mm disclosed herein are merely exemplary in nature and hence, non-limiting of this disclosure. These values can be changed depending on specific requirements of an application.

Although a functional relationship of a proportional controller is depicted in FIG. 5, and the inversely proportional relationship between error and travel speed is described in conjunction with the proportional controller, it is envisioned to optionally use other types of controllers commonly known in the art. Some examples of controllers commonly known in the art may include, but is not limited to, a proportional-integral controller (PI controller), a proportional-derivative (PD controller) controller, and a proportional-integral-derivative controller (PID controller). The other types of controllers depending on specific requirements of an application.

Figure 9:
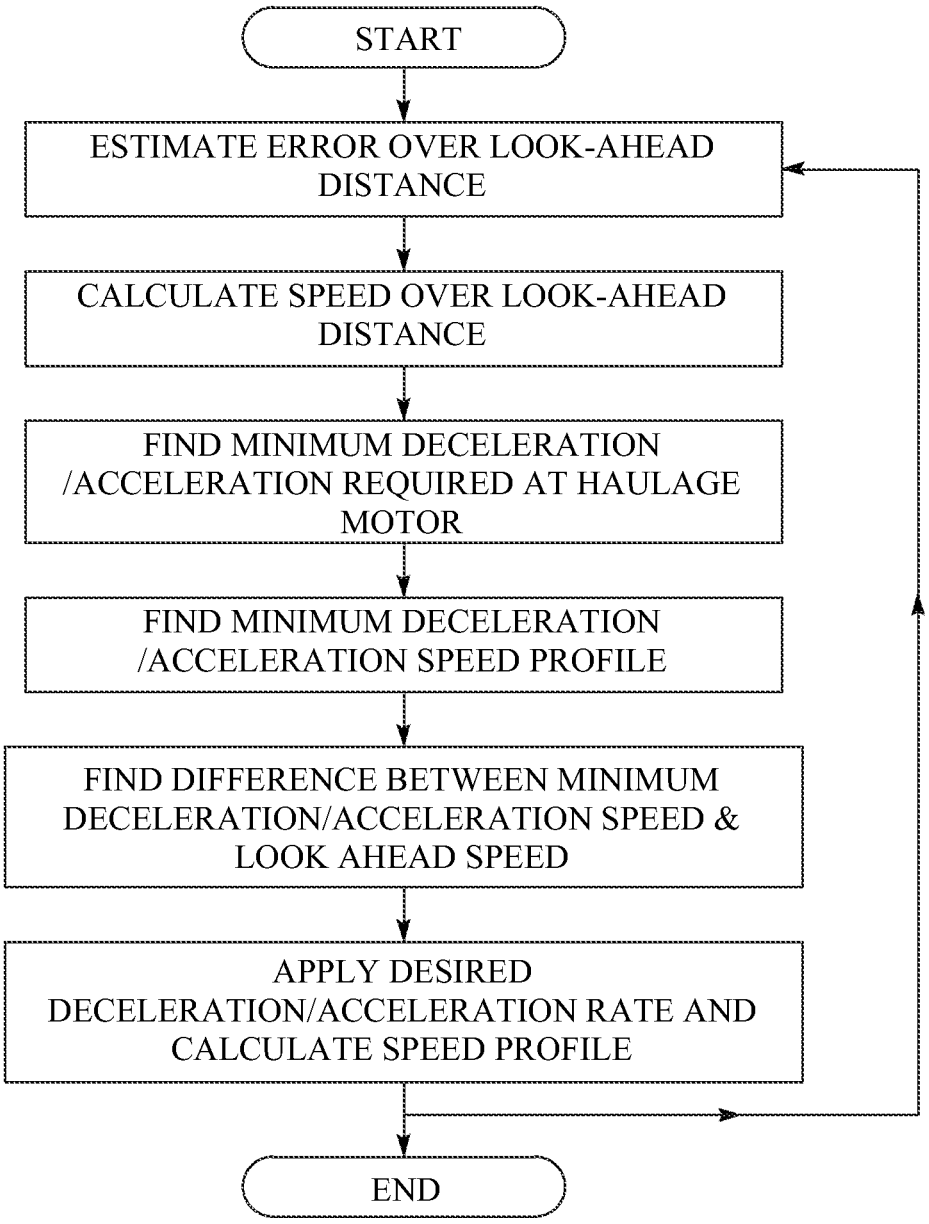
FIG. 9 is an flowchart representing steps of functioning of the controller in accordance with an exemplary embodiment of the present disclosure.

For the sake of clarity in understanding the present disclosure, the aforesaid disclosure is re-capitulated and the functions of the controller 120 are exemplarily represented in FIG. 9. However, it should be noted that the flowchart depicted in FIG. 9 is provided only in the illustrative sense to impart clarity in understanding of the present disclosure and should in no way be construed as limiting of this disclosure. Other alternatives can also be provided where one or more steps are added to the exemplary flowchart of FIG. 9, one or more steps are removed, or one or more steps are provided in a different sequence without departing from the scope of the claims herein.

With reference to various embodiments of the present disclosure, a person of ordinary skill in the art will appreciate that the controller 120 can be readily embodied in the form of an ECM (electronic control module) package and may be easily implemented for use with the longwall shearer 100. The ECM may include various associated system hardware and/or software components such as, for example, input/output (I/O) devices, analog-to-digital (A/D) converters, processors, micro-processors, chipsets, read-only memory (ROM), random-access memory (RAM), and secondary storage devices such as, but not limited to, diskettes, floppies, compact disks, or Universal Serial Bus (USB), but not limited thereto. Such associated system hardware may be configured with various logic gates and/or suitable programs, algorithms, routines, protocols in order to execute the functions of the controller 120 disclosed in the present disclosure. Therefore, various embodiments, modifications, and/or variations can be possible in the present controller 120 for executing the aforesaid functions without deviating from the spirit of the present disclosure.

INDUSTRIAL APPLICABILITY

Figure 10:
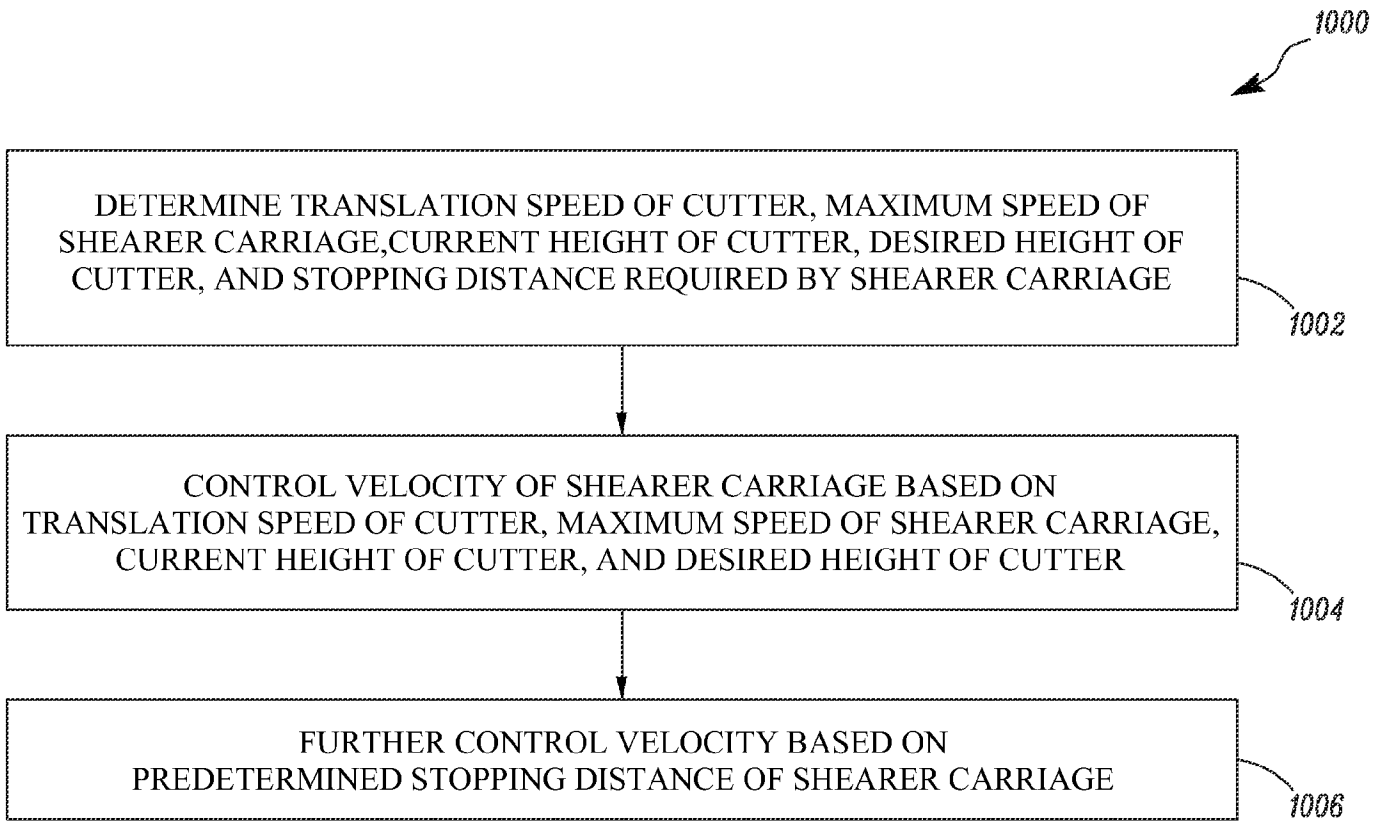
FIG. 10 is a method of controlling a shearer carriage of the exemplary shearer system of FIG. 1.

FIG. 10 shows a method 1000 of controlling the shearer carriage 104 of the shearer system 100. At step 1002, the method 1000 includes determining the translation speed of the cutter 106, the maximum speed of the shearer carriage 104, the current cutter height, the desired cutter height, and the stopping distance of the shearer carriage 104. In an embodiment, the method 1000 includes determining the desired height of the cutter 106 from the profile map of the coalface 102. The method 1000 includes predicting an error based on the difference between the current cutter height and the desired height of the cutter 106 obtained from the profile map. As disclosed earlier herein, the controller 120 predicts the magnitude of error by comparing the current position of the cutter 106 with the data pertaining to the coalface 102 from the profile map.

At step 1004, in one embodiment, the method 1000 includes controlling a velocity of the shearer carriage 104 based on the translation speed of the cutter 106, the maximum speed of the shearer carriage 104, the current cutter height, and the desired height of the cutter 106. However, in another embodiment as shown at step 1006, the method 1000 includes further controlling the velocity of the shearer carriage 104 based on the predetermined stopping distance of the shearer carriage 104 in addition to controlling velocity based on the translation speed of the cutter 106, the maximum speed of the shearer carriage 104, the current cutter height, and the desired cutter height. In an exemplary embodiment, the method 1000 includes reducing the rotational speed of the haulage motor 112 based on a predicted increase in the magnitude of error. Also, the method 1000 additionally includes determining the rate of deceleration required at the haulage motor 112 based on the response characteristics of the haulage motor 112. As disclosed earlier herein, the controller 120 may reduce the rotational speed of the haulage motor 112 based on the predicted increase in the magnitude of error, and in doing so, the controller 120 may use the determined rate of deceleration while reducing the rotational speed of the haulage motor 112.

In another embodiment, the method 1000 includes increasing the rotational speed of the haulage motor 112 if the predicted error is less than a maximum error limit $E_{max}$, the maximum error limit being based on operating specifications of the longwall shearer 100, dimensional specifications of the coalface 102, and shearer geometry. As disclosed earlier herein, the controller 120 may increase the rotational speed of the haulage motor 112 if the predicted error is found to be lesser than the maximum error limit $E_{max}$. Therefore, if the controller 120 determines that the predicted error is less than the maximum error limit Emax, then the controller 120 may command an increase in the rotational speed of the haulage motor 112 (as shown in FIG. 5). Further, in this case, the controller 120 may optionally determine the rate of acceleration and use such determined rate of acceleration in increasing the rotational speed of the haulage motor 112.

With reference to various embodiments of the present disclosure, the method 1000 may further include determining the rate of change of rotational speed (acceleration or deceleration) required at the haulage motor 112 based at least in part on the response characteristics of the haulage motor 112 and/or the actuator 108. With use of the response characteristics as disclosed herein, the controller 120 can account for system-limitations of the longwall shearer 100, if any, and execute speed modulation of the haulage motor 112 with regard to such system-limitations.

Although, some previously known systems were developed to allow autonomous operation of longwall shearers, such systems did little or nothing to vary the travel speed of longwall shearers based on deviations anticipated in coal extraction and mining productivity with respect to optimal/maximum values for an onward coalface. Therefore, in some cases, use of such systems may not configure the longwall shearers to closely track the profile of the coalface while also maintaining maximum and/or optimum travel speed.

Moreover, longwall shearers are typically bulky and heavy in construction. In some cases, the longwall shearer may weigh, for example, 70 tonnes, 80 tonnes, or even 100 tonnes. Haulage motors that are employed to haul the longwall shearer are subject to heavy loads during operation. Further, the haulage motor and/or actuators of the cutters may be unable to operate with high rapidity due to system inertia of the longwall shearer and the load on the cutters. In addition to this, slopes, if any, in the rail assembly may cause the haulage motor to rotate at faster speeds on the rail assembly. Such faster rotation may cause faster travel speed of the longwall shearer and hence, cut down time available for actuators to articulate the cutters into the desired position i.e., articulate the cutters into the desired position before encountering conditions imminent from onward locations of the coalface.

With implementation of the present controller 120 onto longwall shearers, the longwall shearers may be configured to adapt, in advance, to conditions imminent from the oncoming coalface 102. Moreover, as the controller 120 is configured with various parameters related to the actuators 120, haulage motors 112, and other components disclosed herein, the gains of the controller 120 do not require tuning to be performed in the field thus saving time, costs, and effort. Such a configuration of the controller 120 disclosed herein provides optimum performance in operation of the longwall shearer 100.

The "look-ahead" capability of the longwall shearer 100, as disclosed herein, refers to the ability of the longwall shearer 100 to look-ahead for errors at the oncoming coalface 102 for the pre-determined stopping distance. The controller can then limit the travel speed of the shearer carriage 104 based on the errors at the oncoming coalface 102 for the pre-determined stopping distance so that the longwall shearer 100 can accomplish articulation of the cutters 106 into target positions before encountering the onward coalface 102. Such limitation to the travel speed of the shearer carriage 104 allows sufficient time to be available for articulation or positioning of the cutters 106 into the desired height. Consequently, with use of the present controller 120, longwall shearers can be configured to closely track and follow the profile of the onward coalface 102 while maintaining a maximum possible travel speed in operation. Therefore, the longwall shearers may accomplish shearing for optimal and/or maximum amounts of coal extraction while also maintaining maximum mining productivity during operation.

While aspects of the present disclosure have been particularly shown and described with reference to the embodiments above, it will be understood that various additional embodiments may be contemplated by the modification of the disclosed machine, systems and methods without departing from the spirit and scope of what is disclosed. Such embodiments should be understood to fall within the scope of the present disclosure as determined based upon the claims and any equivalents thereof.

We claim:

1. A mining shearer system for removing material along a mineable distance relative to a mining environment, the system comprising:

a rail assembly to support movement of a shearer carriage thereon, the shearer carriage having at least one rotatably driven cutter, said at least one cutter being positionable relative to the shearer carriage;

a haulage motor in drivable engagement with the shearer carriage, the haulage motor being structured and arranged to move the shearer carriage along the rail assembly;

an actuator supported by the shearer carriage, the actuator being structured and arranged to change a cutting height of the at least one cutter;

a controller configured to control a velocity of the shearer carriage based on a translation speed of the cutter, a maximum speed of the shearer carriage, and a current and a desired height of the cutter.

2. The system according to claim 1, wherein the controller is configured to further control the velocity of the shearer carriage based on a predetermined shearer stopping distance, and the current and desired cutter heights.

3. The system according to claim 1, wherein the desired height of the cutter is predetermined based on a profile map of the coalface, the profile map being preset into the controller.

4. The system according to claim 3, wherein the controller is configured to predict an error based on a difference between the current height of the cutter and the desired height obtained from the profile map for at least the predetermined stopping distance of the shearer carriage.

5. The system according to claim 4, wherein the controller is configured to reduce the rotational speed of the haulage motor based on a predicted increase in the magnitude of error.

6. The system according to claim 4, wherein the controller is configured to halt the shearer carriage if the predicted error exceeds a maximum error limit, the maximum error limit being based on at least one of:

operating specifications of the longwall shearer;

dimensional specifications of the coalface; and shearer geometry.

7. The system according to claim 6, wherein the actuator is configured to increase the rotational speed of the haulage motor if the predicted error is less than the maximum error limit.

8. The system according to claim 1, wherein the controller is further configured to determine a rate of deceleration required at the haulage motor based at least in part on response characteristics of the haulage motor.

9. A mining shearer system for removing material along a mineable distance relative to a mining environment, the system comprising:

a rail assembly to support movement of a shearer carriage thereon, the shearer carriage having at least one rotatably driven cutter, said at least one cutter being positionable relative to the shearer carriage;

a haulage motor in drivable engagement with the shearer carriage, the haulage motor being structured and arranged to move the shearer carriage along the rail assembly;

an actuator supported by the shearer carriage, the actuator being structured and arranged to change a cutting height of the at least one cutter;

a controller configured to control a velocity of the shearer carriage based on one of the following:

a translation speed of the cutter, a maximum speed of the shearer carriage, and a current and a desired height of the cutter; and the translation speed of the cutter, the maximum speed of the shearer carriage, a predetermined shearer stopping distance, and the current and desired heights of the cutter.

10. The system according to claim 9, wherein the desired height of the cutter is predetermined based on a profile map of the coalface, the profile map being preset into the controller.

11. The system according to claim 10, wherein the controller is configured to predict an error based on a difference between the current height of the cutter and the desired height obtained from the profile map for at least the predetermined stopping distance of the shearer carriage.

12. The system according to claim 11, wherein the controller is configured to reduce the rotational speed of the haulage motor based on a predicted increase in the magnitude of error.

13. The system according to claim 11, wherein the controller is configured to reduce a travel speed of the shearer carriage to a minimum crawling speed if the predicted error exceeds a maximum error limit, the maximum error limit being based on at least one of:

operating specifications of the longwall shearer;

dimensional specifications of the coalface; and shearer geometry.

14. The system according to claim 13, wherein the actuator is configured to increase the rotational speed of the haulage motor if the predicted error is less than the maximum error limit.

15. The system according to claim 9, wherein the controller is further configured to determine a rate of deceleration required at the haulage motor based at least in part on response characteristics of the haulage motor.

16. A method of controlling a shearer carriage of a mining shearer system having a haulage motor in drivable engagement with the shearer carriage, and at least one rotatably driven cutter associated with the shearer carriage for removing material along a coalface, the method comprising:

determining a translation speed of the cutter, a maximum speed of the shearer carriage, a current and a desired height of the cutter, and a stopping distance required by the shearer carriage; and controlling a velocity of the shearer carriage based on one of the following:

the translation speed of the cutter, the maximum speed of the shearer carriage, the current cutter height, and the desired height of the cutter; and the translation speed of the cutter, maximum speed of the shearer carriage, a predetermined shearer stopping distance, and the current and desired heights of the cutter.

17. The method according to claim 16, wherein the method includes determining the desired height of the cutter from a profile map of the coalface, the profile map being provided for at least the determined stopping distance of the shearer carriage.

18. The method according to claim 17, wherein the method includes predicting an error based on a difference between the current cutter height and the desired height of the cutter obtained from the profile map.

19. The method according to claim 18, wherein the method includes reducing the rotational speed of the haulage motor based on a predicted increase in the magnitude of error.

20. The method according to claim 18, wherein the method includes increasing the rotational speed of the haulage motor if the predicted error is less than a maximum error limit, the maximum error limit being based on at least one of:

operating specifications of the longwall shearer;

dimensional specifications of the coalface; and shearer geometry.

21. The method according to claim 16, wherein the method further includes determining a rate of deceleration required at the haulage motor based at least in part on response characteristics of the haulage motor.

* * * * *